United States Patent [19]

Fellers et al.

[11] Patent Number: 4,680,873

[45] Date of Patent: Jul. 21, 1987

[54] METHOD FOR CONTROLLING SHRINKAGE AND/OR STRETCHING OF A PAPER WEB IN THE DRYING SECTION OF PAPER MACHINE, IN THE FORM OF A CYLINDER DRIER AND/OR FAN DRYER, TRANSVERSELY TO THE FEED DIRECTION OF THE WEB AND ARRANGEMENTS FOR CARRYING OUT THE METHOD

[75] Inventors: Christer Fellers, Sollentuna; Myat Htun, Vällingby; Torbjörn Hansson, Stockholm, all of Sweden

[73] Assignee: Flakt AB, Stockholm, Sweden

[21] Appl. No.: 787,806

[22] PCT Filed: Feb. 11, 1985

[86] PCT No.: PCT/SE85/00068

§ 371 Date: Nov. 27, 1985

§ 102(e) Date: Nov. 27, 1985

[87] PCT Pub. No.: WO85/03534

PCT Pub. Date: Aug. 15, 1985

[30] Foreign Application Priority Data

Feb. 9, 1984 [SE] Sweden ..... 84-00678

[51] Int. Cl.[4] ..... F26B 13/08

[52] U.S. Cl. ..... 34/116; 34/117; 34/158; 68/5 D

[58] Field of Search ..... 226/93; 34/158, 162, 34/163, 155, 114, 116, 117, 120, 122, 123, 23, 12; 68/5 C, 5 D, 5 E

[56] References Cited

U.S. PATENT DOCUMENTS

| | | | |
|---|---|---|---|
| 1,104,759 | 7/1914 | Sheahan | 34/117 |
| 1,707,015 | 3/1929 | Jones | 34/158 |
| 3,452,447 | 7/1969 | Gardner . | |
| 3,650,043 | 3/1972 | Overly et al. | 34/156 |

*Primary Examiner*—Larry I. Schwartz

*Attorney, Agent, or Firm*—Oblon, Fisher, Spivak, McClelland & Maier

[57] ABSTRACT

The present invention relates to an arrangement and a method for controlling or regulating shrinkage and/or stretching of a paper web transversely to the transport direction thereof in a drying section of a paper machine, this drying section having the form of a cylinder dryer (6) and/or a fan dryer. At a point in the drying process at which the paper web exhibits a dry solids content of at most 75%, the paper (10) is subjected to an outwardly directed force which is forced to act in the edge portion (10*a*, 10*b*) of the web. The forces are caused to act adjacent parallel edge portions (10*a*, 10*b*) of the paper web and are directed away from each other. The magnitude of these forces is selected so that they fall beneath shrinkage forces occurring momentary on the paper web at the dry solids content in question by at most 50%.

45 Claims, 12 Drawing Figures

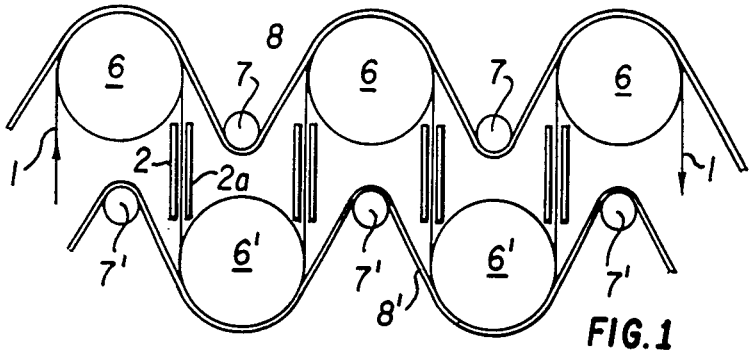
FIG. 1
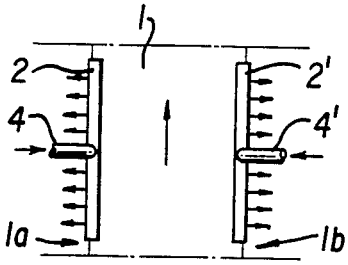
FIG. 2
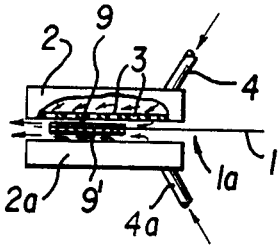
FIG. 3
FIG. 4
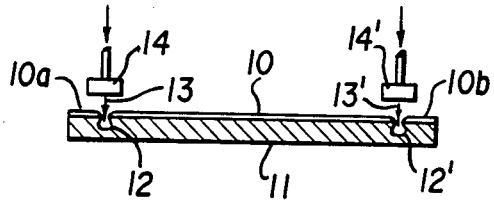
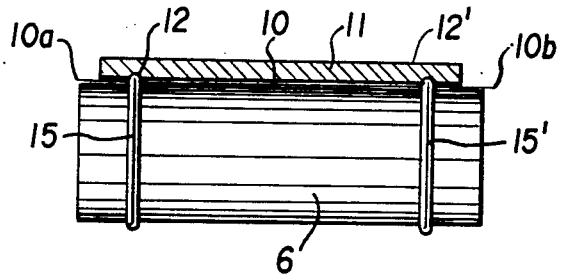
FIG. 5
FIG. 6
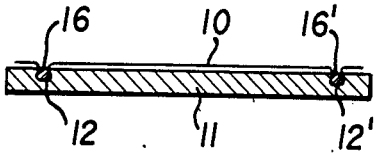

METHOD FOR CONTROLLING SHRINKAGE AND/OR STRETCHING OF A PAPER WEB IN THE DRYING SECTION OF PAPER MACHINE, IN THE FORM OF A CYLINDER DRIER AND/OR FAN DRYER, TRANSVERSELY TO THE FEED DIRECTION OF THE WEB AND ARRANGEMENTS FOR CARRYING OUT THE METHOD

TECHNICAL FIELD

The present invention relates to a method for controlling or regulating shrinking and/or stretching of a paper web transversely to the transport direction of the web in the drying section of a paper machine in the form of a cylinder drier and/or a fan dryer.

The invention also relates to arrangements for controlling shrinkage and/or stretching of a paper web in the drying section of a paper machine in the form of a cylinder dryer and/or a fan dryer, transversely to the transport direction of the web.

BACKGROUND ART

A number of mutually different drying sections intended for paper machines are known to the art, the majority of which sections incorporate a cylinder dryer and/or a fan dryer with which to effect drying of the web. It has long been known that, when drying a paper web in the drying section of a paper machine, the web tends to shrink in both the longitudinal and transverse directions thereof It is also known that shrinking of the web in its transport direction or machine direction can be controlled by driving mutually adjacent drying means in the drying section at different speeds. It is also known that improved values, or an improved index, can be achieved with regard to the strength properties of paper, by controlled reduction of shrinkage of the paper web in its axial or transport direction.

It is also known that controlled reduction in web shrinkage transversely to the web axis cannot be achieved in dryers of the aforesaid kind.

It has been shown, however, that a small force of certain magnitude acts across the whole width of the paper web, from the centre of the web outwards, as a result of the friction prevailing between the peripheral surface of a drying cylinder and the web. In connection with the known art there is described and illustrated in U.S. Pat. No. 3,650,043 an arrangement designed to stabilize a dried paper web by blowing air thereonto in a manner to stretch the web.

U.S. Pat. No. 3,452,447 also describes an arrangement for stabilizing a dried paper web by blowing streams of air thereonto so that the web is stretched.

It should be emphasized here that these paper webs have a dryness in excess of 75% and preferably about 95%.

DISCLOSURE OF THE PRESENT INVENTION

Technical Problems

With regard to the prior technical standpoint in this art, the realization that the final strength properties of a dried paper web are dependent on the extent to which the finished paper has been permitted to shrink in different directions and that different degrees of shrinkage will result in varying properties in different directions means that a technical problem must be considered to exist in the provision of conditions, with the aid of simple means, which enable all strength properties of a dried paper to be controlled or regulated, by "all strength properties" we include flexural rigidity, tensile strength, tensile rigidity, and compression strength in the various directions.

It must also be considered a more qualified technical problem to take measures such that the strength properties can be regulated in a simple fashion transversely to the transport direction of a paper web to be dried.

Another technical problem in this regard is one of providing with the aid of simple means conditions which enable shrinkage of a paper web to be dried to be controlled and counteracted transversely to the transport direction of the web, and also to provide conditions whereby the web can be stretched in the transverse direction.

When considering the fact that a varying degree of stretch, to counteract shrinkage or elongation in different directions, will impart varying properties to the finished paper in different directions, it must be considered a technical problem in relation to the present standpoint of the art to create with the aid of simple means conditions which enable these properties to be substantially equalizied in the various directions.

Another technical problem is one of enabling measures to be taken which ensure that the paper web in the dryer section is dimensionally more stable.

A further qualified technical problem is one of ensuring that a paper web dried in the drying section of a paper machine obtains a uniform transverse profile, thereby reducing the occurrence of so-called margin or edge effects, by which is meant marginal dried-web portions of lower strength properties.

A still further technical problem relates to the use of the specific peculiarity that variations in the extent to which stretching is effected, to counteract shrinkage or to produce elongation in different directions, will result in a finished paper having varying properties in the different directions, such that these properties can be adapted to pre-determined requirements with the aid of simple means.

Another technical problem is one of providing a simple, inexpensive, and operationally reliable arrangement which affords a solution to the aforementioned technical problems and which can be adapted for ready installation in existing drying sections.

A further technical problem is one of providing ways and means whereby stretching of the paper web transversely to its longitudinal axis can be adapted so as not to result in a reduction of the mechanical properties desired in the paper web in its transport direction.

It must also be considered problematic from a technical aspect to obtain, with the aid of simple means, a dried paper web of improved quality, so as to enable thereby the selection of a lower surface weight and an increased filler mixture or an admixture of cheaper fibres to be used while maintaining the properties of the paper.

Another technical problem is one of providing means which enable those forces which are applied to the edge portions of a paper web to counteract the shrinking tendencies of the paper or which, when increased slightly, cause the paper web to stretch in its transverse direction, to be applied to the web at the lowest possible dry solids content thereof i.e., preferably in or immediately downstream of the press section, preferably when the dry solids content of the paper web is somewhat above 30%.

As will be readily understood, those forces applied to the edge portions of a paper web of low dry solids content, to counteract shrinkage, will not be as high as the forces applied to a web of higher dry solids content for the same purpose, and consequently a further technical problem is one of providing means whereby the forces applied to the said edge portions can be controlled identically or substantially identically and/or mutually differently, in dependence on the properties desired, in order to counteract the lateral shrinkage tendency of the paper web.

SOLUTION

The present invention relates to a method and an arrangement for regulating or controlling the shrinkage and/or stretching of a paper web which is to be dried in the drying section of a paper machine, in the form of a cylinder dryer and/or fan dryer, transversely to the feed direction of the web.

It is proposed herewith, in accordance with the invention, that means capable of co-acting with an edge portion or edge portions of the paper web is, or are, located along the whole or part of the drying section where the dry solids content of the paper web is at most 75%. The means are arranged to exert on the paper web an outwardly or transversely directed resisting force adapted to counteract substantially shrinkage of the paper web and even to stretch the web. Preferably, the forces are adapted to counteract shrinkage to an equal or substantially equal extent throughout the whole drying interval. The means generating the aforesaid forces are preferably arranged in pairs on respective sides of the paper web, such that the edge portions of the web are subjected to outwardly acting forces which are effective throughout the whole or a part of a given drying interval.

In accordance with one particular embodiment of the invention, stretching of the paper web transversely to its transport direction with the aid of externally applied forces is effected at a location where the dry solids content of the web exceeds 30%, such that the web need not be substantially stretched at remaining locations in the drying section at which the dry solids content is in excess of 75%.

Although the means which apply the aforesaid outward lateral force to the paper web, and particularly to the edge portions thereof, may have many different forms, it is proposed that the means comprise devices adapted to direct streams of pressurized air against the edge portions of the web, so as to create outwardly acting frictional forces against the paper. The aforesaid means may also comprise a device which will produce forces which counteract shrinkage and/or induce stretch in the transverse direction of the web through frictional and/or clamping forces. Alternatively, the means may comprise an arrangement which is effective to create forces on the web in a manner to counteract shrinkage and/or induce stretching in the transverse direction thereof, through a combination of pressurized air/streams and mechanical devices.

Because large forces are required to stretch a wide paper web, and because the magnitude of the forces required to effect a given degree of stretch increases greatly with increasing dry solids content of the web, it is proposed that one or more strip-like members be arranged along respective edge portions of the web for co-action therewith, and that there be provided a number of air boxes adapted to produce air streams which can be caused to press the edges of the web against respective strip-like members. Alternately, the edge portions of the web can be pressed against a respective strip-like member with the aid of purely mechanical means, preferably with the aid of rotating brushes or opposing strip-like devices. In this latter case, it is proposed that the strip-like members be highly permeable to air and readily plastically deformed. The strip-like members may also be embossed or profiled to provide well-defined coaction with the edge portions without appreciable relative movement therebetween, therewith to provide an arrangement which creates forces which act substantially outwardly, such as to compensate fully for any tendency of the web to shrink, while simultaneously increasing the magnitude of the forces with increasing dry solids contents of the web.

Although the strip-like members may be made of rubber, plastics, or textile material, they are preferably made of metal, such as stainless steel.

In order to obtain forces sufficient to counteract or resist the tendency of the web to shrink at high dry solid contents, the aforesaid embossments suitably have the form of depressions made in the strip so as to perforate the strip, thereby enabling relatively high forces to act in respective directions relative to the transport direction of the paper web. Conditions are also created hereby which enable the paper web to stretch in its transverse direction, so that it can also be extended in that direction.

The strip-like member may suitably extend along the whole of the intended drying part, and it is then conveniently divided into sections. The aforesaid means comprises a boxlike structure provided with an air inlet and having channels which are directed obliquely outwards towards the edges of the paper web, placed on a respective side of the web. In accordance with the invention, several such box-like structures are placed in the free draw of the drying section, by which is meant the distance between two adjacent drying cylinders.

Alternatively, the aforesaid means may comprise suction boxes located on respective sides of the web in the proximity of the edge portions thereof, and including channels which are directed towards the centre of the web. An auxiliary strip-like member may be arranged to accompany the paper web in a manner to increase the friction between the web and the air stream.

The aforesaid means may alternatively have the form of mutually spaced grooves which are formed in the wire accompanying the paper web and into which the edge portions of the web are pressed so as to hold the web firm. This downward pressing of the web edge-portion is preferably effected with the aid of one or more jets of pressurized air exiting from one or more nozzles associated with respective grooves.

The web edge-portions may also be pressed into the grooves with the aid of one or more rings mounted on a roller, or may be effected with the aid of strip-like devices.

As a further alternative, the aforesaid means may comprise strip-like members which are arranged on each side of the web edge and positionally fixed over drying cylinders, and which accompany the paper web continuously through a plurality of drying cylinders. The strip-like member is thus fixed to the cylinders through the agency of grooves formed therein, and a further strip-like member, (e.g., a drying felt) is arranged between the two aforesaid mutually spaced striplike members. The strip-like members can be secured by means of a ring fitted to the roller. Finally, the edge-portions of the paper web may be fastened between two superimposed strip-like members, of which one member has provided on one surface thereof elongated beads or punctiform studs which are adapted to mate with corresponding recesses or grooves in the facing surface of the other strip-like member.

Advantages

Those advantages primarily afforded by a method and arrangement according to the invention reside in the possibility of controlling the strength properties of a dried paper web in the transverse direction thereof, by applying to the web during the drying process, at a location therein where the web has a dry solids content of 75 %, stretching or resisting forces such as to counteract shrinking tendencies of the web. In this way there is obtained a dried paper web of improved and controllable properties, (e.g., such properties as flexural rigidity, tensile rigidity, tensile strength and compression strength) in all directions.

BRIEF DESCRIPTION OF THE DRAWINGS

Proposed embodiments at present preferred and exhibiting the significant features of the invention and capable of being used to advantage in a method according to the invention will now be described in more detail with reference to the accompanying drawings,in which FIG. 1 illustrates schematically and in side view a drying section forming part of a paper machine;

FIG. 2 is a plan view of an arrangement having two members for producing laterally directed forces relative to the transport direction of a paper web, with the aid of air under pressure;

FIG. 3 is a plan view of the arrangement illustrated in FIG. 2;

FIG. 4 is a sectional view of a slalom wire having grooves provided along the edges thereof;

FIG. 5 illustrates a slalom wire arrangement in which a cylinder is provided with two peripheral rings which engage corresponding grooves in the wire, to press the paper web into said grooves;

FIG. 6 illustrates a slalom wire arrangement in which the web is pressed into two grooves and held therein with the aid of strip-like members;

DESCRIPTION OF EMBODIMENTS AT PRESENT PREFERRED

Figure 7:
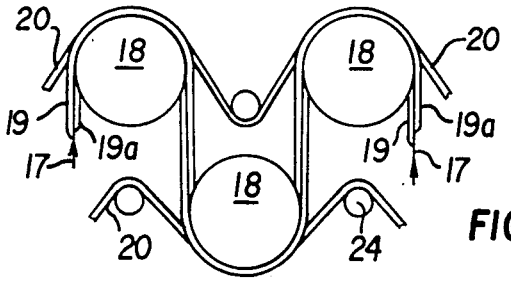
FIG. 7 illustrates schematically and in side view a drying section which forms part of a drying machine and which has arranged therein means for generating forces which are directed laterally relative to the transport direction of the web and which are adapted to take-up shrinkage dependent forces.

FIG. 1 illustrates schematically and in side view a drying section which forms part of a paper machine and which includes upper drying cylinders 6, lower drying cylinders 6', upper felt-guide rolls 7, and lower felt-guide rolls 7'. The paper web to be dried is referenced 1. Extending over the upper drying cylinders 6 and the upper guide rolls 7 is an upper drying felt 8, while a lower drying felt 8' extends over the lower drying cylinders 6' and the lower guide rolls 7'.

Located on either side of the paper web in the open draw between the cylinders 6 and 6' adjacent edge portions **1*a* and 1*b* of the web are box-like structures 2 and 2', so-called blow boxes, which are adapted to cover the edge portions of the web. The blow boxes 2 are shown more clearly in FIG. 3**.

Pressurized air is supplied to the blow boxes 2, **2*a* through a respective inlet 4 and 4*a* and is caused to flow therefrom at high velocity through channels 3 directed obliquely outwards towards and away from the paper web. The streams of air thus produced bear against the web and the resultant frictional forces acting outwardly on the web prevent the web from shrinking in its transverse direction, and may also result in a certain amount of stretch. For the purpose of increasing the frictional forces acting between the air streams and the web, it is proposed that frictionenhancing strips 9 and 9' are arranged on mutually opposite sides of the edge portion 1*a* of the web, and also the edge portion 1*b*** thereof.

The arrangement illustrated in FIGS. 4 to 6 is intended for use in paper machine where the drying section incorporates a so-called slalom wire. In a drying section which incorporates a slalom wire, the paper web lies between drying cylinders and wire, over each alternate cylinder. Over the "next" alternate cylinder, the wire lies between the drying cylinder and the web.

In the FIG. 4 embodiment, the wire 11 has grooves 12,12' provided along the edges thereof. As illustrated in the Figure, the edge portion **10*a* of the web 10 is pressed into the grooves 12 by a pressurized air jet 13 exiting from a nozzle 14. The edge portion 10*a* is held in the groove 12 by the air jet 13. Similarly, the other edge portion 10*b* of the web 10 is pressed into a groove 12' and held therein by a pressurized air jet 13' exiting from a nozzle 14'**.

As shown in FIG. 5, the paper web 10 may also be held to the wire 11 in the groove 12 or 12' during passage of the web 10 over the upper drying cylinder 6 with the aid of two rings 15 and 15' respectively, peripherally arranged on the upper drying cylinder 6 and engaging the grooves 12, 12', to press the web 10 thereinto.

FIG. 6 illustrates another variant in which the paper web 10 is held pressed into respective grooves 12 and 12' with the aid of a respective strip-like member 16 and 16', so as to hold the web 10 to the wire 11.

FIGS. 7–11 illustrate other arrangements and devices for holding the edge portions of the paper web against the cylinders and therewith fix the edge portions of the web so that the web can be dried without shrinking in its transverse direction, by applying external forces along the edge portions of the web to counteract shrinking tendencies.

A certain amount of stretch may also be obtained in the transverse direction of the web, especially at low dry solids content.

A common feature of these arrangements is the use of a so-called edge strip which is arranged to accompany a paper web 17 continuously through each drive group of drying cylinders.

Pairs of edge strips, such as those references 19, 19*a*, may be fixed in their mutual positions beyond the drying cylinders in various ways.

The pair of edge strips 19,19*a* for one edge portion 17*a* of the paper web 17 and the pair of edge strips 19', 19*a'* for the other edge portion 17*b* are spaced axially at a given distance apart, and each pair of edge strips 19, 19*a* and 19',19'*a* is intended to exert a high frictional force on a respective edge portion 17*a*, 17*b* of the web 17.

Figure 8:
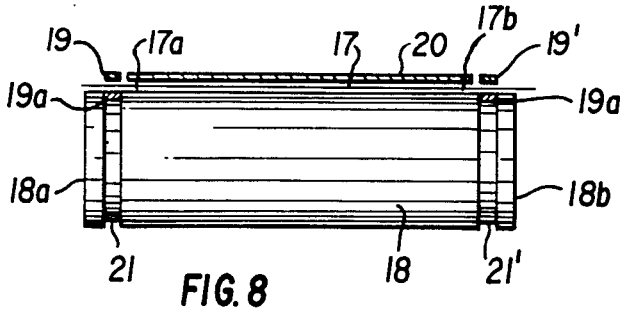
FIG. 8 illustrates an arrangement in which an edge strip is located on either side of the web edge portions and holds the edge portions firmly to the cylinder in grooves located therein.

In the FIG. 8 embodiment, the edge-strip pairs 19, 19*a* and 19', 19*a'* are located on either side of the edge portions 17*a*, 17*b* of the paper web 17 and are held against relative movement along a cylinder 18 in grooves 21, and 21' formed at respective ends 18*a* and 18*b* of the cylinder 18. The effect can be further enhanced by providing a stiff or rigid drying felt 20 between the edge strips 19, 19*a* and 19', 19'*a*. The felt 20 functioning as a "precision block" therebetween and preventing shrinkage of the web 17.

Figure 9:
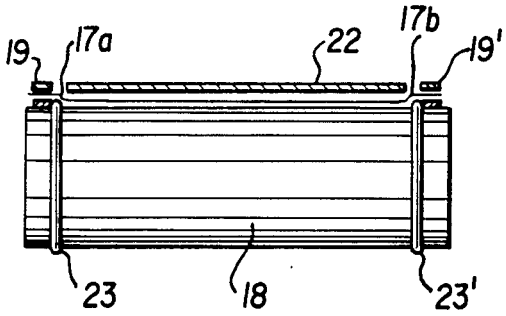
FIG. 9 illustrates an arrangement in which edge strips are held to or guided against the cylinder with the aid of two rings.

In the FIG. 9 embodiment, the pairs of edge strips 19, 19*a* and 19', 19'*a* and the edge portions 17*a* and 17*b* of the paper web 17 are held and guided by respective rings 23 and 23' located around the cylinder 18. This embodiment also employs a stiff or rigid drying felt 22, the defining edge surfaces of which are located adjacent the mutually facing surfaces of respective rings 23 and 23'.

It will be understood that the edge strips and coacting edge-strip pairs may differ in form, so as to provide sufficiently reliable co-action with the edge portions of the paper web to withstand outwardly acting forces due to shrinkage, and so as to be able to co-act with the end parts of the cylinder without being unduly displaced towards one another by said forces, but remain firm at a given set distance apart.

Figure 10:
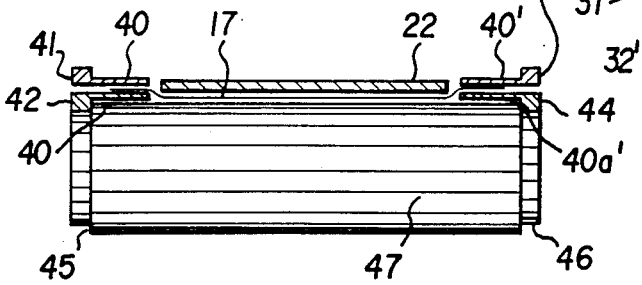
FIG. 10 illustrates an arrangement which incorporates edge strips having two longitudinally extending flanges, such that the flanges of two similarly located edge strips will co-act with and be held against recesses formed in the peripheral surface of the cylinder, preferably adjacent to the end walls thereof.

The FIG. 10 embodiment incorporates pairs of edge strips 40, 40*a* and 40', 40*a'* provided with longitudinally extending flanges 41, 42, 43 and 44, where the edge strips 40*a* and 40*a'* co-act with and are firmly held in a respective recess 45 and 46 formed in end-wall parts of a cylinder 47.

The edge strips can be attached to and caused to co-act with the edge portions of the paper web 17 in various ways.

Figure 11:
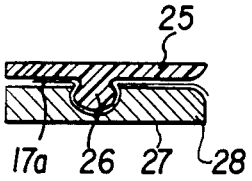
FIG. 11 illustrates an arrangement in which one end strip is provided with a longitudinally extending groove and the mutually co-acting edge strip with a corresponding longitudinally extending bead.

FIG. 11 illustrates an arrangement in which a first edge strip 28 is provided with a longitudinally extending groove 27, while a second strip is provided with a corresponding longitudinally extending elongated bead 26 arranged to engage the groove 27 and to hold the edge portion 17*a* firmly therein. As will be understood, instead of continuous grooves and beads there may be arranged along the edge strip a plurality of mutually spaced studs adapted to engage respective recesses. The strips may also have the form of Velcro-strips or burr-type fasteners.

In the case of all strips lying on the drying cylinder (i.e. not located in grooves), the edge of the edge strip will be chamfered or bevelled, so as to avoid interruptions in the paper web.

The second edge strip 25 may advantageously have the form of a steel band provided with embossments (pins distributed along the band), while the first edge strip 28 may be of a material which will gently receive the embossments, such that the edge portions of the paper web are held in punctiform manner.

Figure 12:
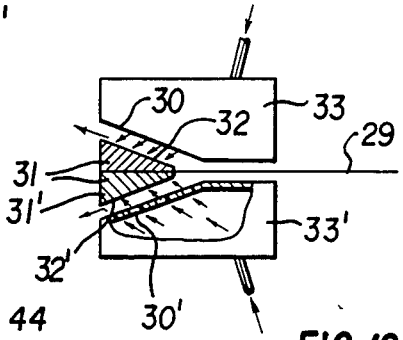
FIG. 12 illustrates an arrangement in which streams of pressurized air are directed through air-injection boxes onto the web, to produce outwardly acting forces on an edge strip co-acting with the edge portion of the web.

Finally, FIG. 12 illustrates an arrangement which comprises a combination of an upper edge strip 31 placed on a paper web 29, and an upper blow-box 33. The upper blow-box 33 is here provided with an oblique surface 30 with outlets serving as air channels. The upper edge strip 31 is correspondingly provided with an oblique surface 32. This arrangement provides substantially greater frictional force. A lower blowbox 33' is provided with an oblique surface 30' with outlets serving as air channels. A lower edge strip 31' is correspondingly provided with an oblique surface 32'.

Thus, the present invention, as illustrated above, relates to an arrangement for controlling or regulating transverse shrinkage and/or stretching of a paper web in the drying section of a paper machine, this section having the form of a cylinder dryer and/or a fan dryer. This is effected by providing means for applying an outwardly directed force to the edge portions of the web at a location in the drying process where the dry solids content of the web is at most 75%. In a majority of the illustrated embodiments, these means are effective to clamp the paper web firmly at the edge portions thereof as the web passes a drying cylinder. When the edge portions of the web are clamped rigidly, the forces produced therewith will resist or counteract the shrinkage forces occurring, so as to prevent shrinkage of the web either completely or to a very substantial extent.

The edge portions of the paper web may be clamped with varying degrees of firmness, so as to obtain greater or smaller frictional forces, so that the resultant outwardly directed forces permit shrinkage of the web to an extent determined by the magnitude of the frictional force created.

It also lies within the scope of the invention to adapt the outwardly directed forces in a manner such as to stretch the paper web in its transverse direction. This is effected to particular advantage during that part of the drying interval when the dry solids content is low, for example between 30 and 50%. In this case, blow-boxes or other means are suitably used in the free draw.

Since the forces acting on the edge portions of the paper web to effect the same degree of stretch increase with an increasing dry solids content, it is suggested that these forces are increased along the drying interval, so that the whole of the drying sequence is effected with substantially identical inner stresses in the transverse direction of the paper web.

The extent to which the paper web is stretched in its longitudinal direction can also be regulated in accordance with known methods, independently of the stretch significant to the invention.

By way of example, it can be mentioned that stretching of the paper web in its transverse direction by 1% at a dry solids content of 40% improves the tensile index of the paper by about 30%, its tensile rigidity index by 23% and its compression index by 34%.

The following conclusions can be drawn from other experiments carried out. All strength properties of the paper in its transverse direction are greatly increased when shrinking is prevented or reduced. The strength properties are further improved when the paper web is wet stretched in its transverse direction, this stretching being preferably effected at the lowest possible dry solids content, preferably in the press section or immediately downstream thereof. When stretching is effected at low dry solids content, lower shrinkage forces are counteracted, meaning that the stretching devices need not be equally as robust as those used for stretching the web at higher dry solids contents. The strength properties are also greatly improved when the paper web is allowed to dry for free shrinkage at dry solid contents in excess of 75%.

Consequently, the drying interval or drying path is located within the region where the dry solids content of the paper web exceeds 30%, preferably between 40 and 75%. As will be understood, the edge portions of the paper web may also be pressed against the strip-like members with the aid of mechanical means other than the previously illustrated means, preferably rotating brushed or opposing strip-like members.

When the strip-like members arranged on a respective side of the drying cylinder have the form of steel strips, it is proposed that embossments are formed in mutual spaced relationship therealong, these embossments advantageously having the form of impressions which perforate the strip. In contact with the embossed strips are strips having relatively soft surfaces, such as to enable the embossments to penetrate therein in a resilient fashion, therewith to clamp respective edge portions of the paper web between the mutually facing surfaces of a respective pair of strip-like members.

In this, and also other embodiments, pairs of edge strips may be caused to diverge in the transport direction of the web on each side thereof, to provide conditions whereby the web can be stretched in its transverse direction.

The strip-like members may extend along the whole of a given drying path or interval and may be divided into sections.

The strip-like members are preferably at most 300 mm wide, preferably from 50 to 200 mm in width.

When the pairs of strip-like members have more or less planar facing surfaces, for clamping one edge portion of the paper web, the clamping force produced can be regulated by stretching or slackening the edge strips, so as to increase or decrease the frictional forces acting on the paper web.

The invention also relates to a method for regulating or controlling shrinkage and/or stretching of a paper web transversely of its transport direction in the drying section of a paper machine, this drying section having the form of a cylinder dryer and/or a fan dryer.

When applying the method according to the invention, the paper web is subjected to an outwardly directed force at that point of the drying process in which the paper web exhibits a dry solids content of at most 75%, therewith obtaining stretching of the fibre orientation transversely to the paper web. The outwardly directed forces are caused to act adjacent the edge portions of the paper web and are intended to be distributed across the whole width of the web. The forces are directed away from one another. The magnitude of the forces is preferably selected so as to lie beneath the shrinkage forces occurring at that moment in time on the paper web at the dry solids content in question by at most 50%.

In accordance with a particular embodiment of the invention, the paper web is subjected to an increase in width during an initial part of the drying interval, preferably at low solids content, at which point it is possible to stretch the paper web in the transverse direction thereof to a width greater than the width of the web upon its entry into the drying section with the aid of minor forces.

It also lies within the scope of the invention to permit the paper web to pass over a roll having a helical form from its centre part out towards the ends thereof, and to cause air jets or like means to press the whole of the paper web into said groove, thereby stretching the web transversely to its transport direction. This guarantees that active forces are distributed substantially uniformly across the whole width of the web.

It will be understood that the invention is not restricted to the aforedescribed embodiments given by way of example, and that modifications can be made within the scope of the following claims.

We claim:

1. A method for controlling or regulating shrinkage and/or stretching of a paper web transversely to its transport direction in a drying section of a paper machine, said drying section having the form of a cylinder dryer and/or a fan dryer, characterized by subjecting the paper web to an outwardly directed force beginning at that point in the drying process where the paper web exhibits a dry solids content of at most 75%, and causing said force to act in the edge portion of the paper web.

2. A method according to claim 1, characterized by causing the force to act within a pre-determined drying interval.

3. A method according to claim 1 or 2, characterized by causing forces opposed directionally to one another to act adjacent parallel edge portions of the paper web; and by selecting the magnitude of the forces so that they fall beneath the shrinkage forces occurring momentarily in the paper web at the dry solids content in question by at most 50%.

4. A method according to claim 3, characterized by selecting forces which stretch the web in its transverse direction by at most 5%, preferably from 0,2 to 2%.

5. A method according to any one of claim 1, characterized by increasing, preferably continuously, in the transport direction of the web during said given drying interval those forces which act outwardly in relation to said web transport direction.

6. A method according to claim 1, characterized by causing the outwardly directed forces, with the aid of separate means, to act solely along the major part of the open draw between cylinders or rolls.

7. A method according to claim 1, characterized in that the outwardly directed forces are created, inter alia, by blowing pressurized air onto the edge portions of the paper web.

8. A method according to claim 1, characterized in that the outwardly directed forces are created, inter alia, by mechanical friction or by a clamping action.

9. A method according to claim 8, characterized by firmly clamping at least one edge portion of the paper web with the aid of one or more strip-like members.

10. A method according to claim 8 or 9, characterized by pressing the two edge portions of the paper web into grooves formed on one or more cylinders, the distance between the grooves being less than the total width of the paper web.

11. A method according to claim 8, characterized by blowing air onto at least one edge portion of the paper web so as to press said edge portion against a profiled strip-like member during a part of said drying interval, preferably at the beginning thereof.

12. A method according to claim 9, characterized by causing the strip-like member or members to accompany the edge portions of the paper web continuously during the whole of said given drying interval.

13. A method according to claim 9, characterized by dividing the strip-like member or members into separate parts, so that each pass through an open draw between two cylinders or rolls.

14. A method according to claim 9, characterized by dividing the strip-like member or members into sections so that each passes through at least one open draw between two cylinders and extends over at least one cylinder.

15. An arragement for controlling or regulating shrinkage and/or stretching of a paper web transversely to its transport direction in a drying section of a paper machine, said drying section having the form of a cylinder dryer and/or a fan dryer, said arrangement comprising means capable of co-acting with an edge portion or edge portions of the paper web, said means:

(a) being arranged along the whole or a part of the drying path beginning at a location where the paper web exhibits a dry solids content of at most 75% and (b) being arranged to exert on a paper web the force which acts outwardly (that is to say, in the transverse direction of the web).

16. An arrangement according to claim 15, characterized by means, preferably pairs of means on a respective side of the paper web, adapted to subject the edge portions of said web to outwardly directed forces which act along the whole of a pre-determined drying path or interval or along a part of said path or interval.

17. An arrangement according to claim 15, characterized in that the drying path is located within that part of the drying section where the dry solids content of the paper web exceeds 30%.

18. An arrangement according to claim 15 or 16, characterized in that said means comprises devices for directing streams of pressurized air onto the edge portions of the web, the frictional forces thus created against the paper web producing the outwardly directed forces.

19. An arrangement according to claim 15, characterized in that said means comprise devices adapted to produce via a frictional and/or clamping effect forces which will fully or substantially fully counteract shrinkage and/or permit minor stretching of the paper web in its transverse direction.

20. An arrangement according to claim 15, characterized in that the means comprise devices for producing through a combination of air blowing and mechanical guiding such forces on the paper web as to totally or substantially totally counteract shrinkage and/or permit stretching of the paper web in its transverse direction.

21. An arrangement according to claim 20, characterized in that a strip-like member is arranged at respective edge portions of the paper web and adapted to co-act with said edge portion.

22. An arrangement according to claim 21, characterized in that blow-boxes are arranged to produce a plurality of air jets such as to press the edges of the paper web against said strip-like member.

23. An arrangement according to claim 21, characterized by mechanical means, preferably rotating brushes or opposing strip-like members, by means of which mechanical contact forces can be created for pressing the edge portions of the web against the first-mentioned strip-like member.

24. An arrangement according to claim 23, characterized in that opposing strip-like members are highly permeable to air and are readily deformed plastically.

25. An arrangement according to claim 21, characterized in that respective strip-like members are embossed or profiled in a manner to afford well-defined co-action with the edge portions of the paper web, substantially without relative movement.

26. An arrangement according to any one of claims 20, 21, 22, or 23, characterized in that the strip-like members are made of a rubber, plastics or textile material, or of metal, preferably steel.

27. An arrangement according to claim 24, characterized in that the aforesaid embossment are formed by depressions made in the metal strip-like member, said depressions preferably being formed so as to perforate the strip.

28. An arrangement according to claim 20, characterized in that strip-like members are arranged to pass through the whole of the given drying path or interval.

29. An arrangement according to claim 20, characterized in that the strip-like members are divided into sections.

30. An arrangement according to claim 20, characterized in that the strip-like member has a width of at most 300 mm, preferably 50 to 200 mm.

31. An arrangement according to claim 15, characterized in that the said means comprises box-like structures (2) which are located on each side of the paper web (1) and arranged to cover respective edge portions of the web, and which are provided with channels (3) directed obliquely outwards towards the edge portions of the web and provided with an air inlet (4).

32. An.arrangement according to claim 15, characterized in that box-like structures (2) are placed in the free draw of the drying section, i.e. in the space between two drying cylinders (6).

33. An arrangement according to claim 31 or 32, characterized in that an auxiliary strip-like member (9) is arranged to accompany the paper web so as to increase the friction between the web and the air jets.

34. An arrangement according to claim 15, characterized in that said means comprises at least one groove (12), in a wire (11) accompanying the paper web (10), the edge portion of the paper web being arranged to be pressed into said at least one groove and held firmly therein.

35. An arrangement according to claim 34, characterized in that arranged to co-act with said at least one groove (12) are one or more nozzles (14, FIG. 4) arranged to produce one or more pressurized air-jets (13) for pressing an edge portion of the paper web into said at least one groove (12).

36. An arrangement according to claim 34, characterized by a ring (15, FIG. 5) on a roll (6) adapted to press an edge portion of the paper web into said at least one groove (12).

37. An arrangement according to claim 34, characterized by at least one strip (16, FIG. 6) adapted to press an edge portion of the paper web into said at least one groove (12).

38. An arrangement according to claim 15, characterized in that said means comprises pairs of strip-like members (19) arranged on the edge portions of the paper web (17) and fixed over drying cylinders (18), said pairs of strip-like members being arranged to accompany the paper web continuously through a number of drying cylinders (FIG. 7).

39. An arrangement according to claim 38, characterized in that respective strip-like members (19) are fixed to respective rolls by grooves (21, FIG. 8) formed therein.

40. An arrangement according to claim 39, characterized in that a further strip-like member (22) for example a drying felt, is arranged between two mutually spaced striplike members (19) facing the drying cylinder.

41. An arrangement according to any one of claim 38, characterized in that the arrangement includes longitudinally extending or punctiform beads (26) on the one strip-like member (25) and corresponding grooves (27, FIG. 11) or recesses in the other (28) of said strip-like members, said beads and said grooves or recesses being arranged to engage one another so as to hold at least one edge portion of the paper web firmly therebetween.

42. An arrangement according to claim 15 or 31, characterized in that channels open onto a surface (30) arranged in the blow-box (33) obliquely in relation to the paper web (29); and in that an edge strip-like member (31) is provided with oblique surfaces (32) extending substantially parallel with the surfaces (30, FIG. 12) of the blow-box.

43. An arrangment for controlling or regulating shrinkage and/or stretching of a paper web transversely to its transport direction in a drying section of a paper machine, said drying section having the form of a cylinder dryer and/or a fan dryer, said arrangement comprising suction boxes which are arranged on each side fo the paper web adjacent the edge portions thereof, said suction boxes including channels directed obliquely inwards towards the center of the paper web, said suction boxes:

(a) being capable of co-acting with an edge portion or edge portions of the paper web;

(b) being arranged along the whole or a part of the drying path at a location where the paper web exhibits a dry solids content of at most 75%; and (c) being arranged to exert on the paper web a force which acts outwardly (that is to say, in the transverse direction of the web).

44. An arrangement for controlling or regulating shrinkage and/or stretching of a paper web transversely to its transport direction in a drying section of a paper machine, said drying section having the form of a cylinder dryer and/or a fan dryer, said arrangemmentcomprising pairs of a strip-like members arranged on the edge portions of the paper web and fixed over drying cylinders, said pair of strip-like members being arranged to accompany the paper web continuously through a number of drying cylinders and at least one of said strip-like members being fixed with the aid of a ring arranged on one of said drying cylinders, said pairs of strip-like members:

(a) being capable of co-acting with an edge portion or edge portions of the paper web;

(b) being arranged along the whole or a part of the drying path at a location where the paper web exhibits a dry solids content of at most 75%; and (c) being arranged to exert on the paper web a force which acts outwardly (that is to say, in the transverse direction of the web).

45. An arrangement for controlling or regulating shrinkage and/or stretching of a paper web transversely to its transport direction in a drying section of a paper machine, said drying section having the form of a cylinder dryer and/or a fan dryer, said arrangement comprising pairs of strip-like members arranged on the edge portions of the paper web and fixed over drying cylinders, said pairs of strip-like members being arranged to accompany the paper web continuously through a number of drying cylinders, said strip-like membes being composed of a Velcro-type strip (that is to say, a burr-fastener type strip), said pairs of strip-like members:

(a) being capable of co-acting with an edge portion or edge portions of the paper web;

(b) being arranged along the whole or a part of the drying path at a location where the paper web exhibits a dry solids content of at most 75%; and (c) being arranged to exert on the paper web a force which acts outwardly (that is to say, in the transverse direction of the web).

* * * * *